US005785208A

United States Patent [19]

Dobbs et al.

[11] Patent Number: 5,785,208

[45] Date of Patent: Jul. 28, 1998

[54] PRECOMPRESSION PUMP SPRAYER HAVING SUCK-BACK FEATURE

[75] Inventors: Douglas B. Dobbs, Yorba Linda; R. Pat Grogan, Downey, both of Calif.

[73] Assignee: Calmar Inc., City of Industry, Calif.

[21] Appl. No.: 630,351

[22] Filed: Apr. 10, 1996

[51] Int. Cl.[6] ..... B67D 1/08

[52] U.S. Cl. ..... 222/148; 222/321.2; 222/321.3

[58] Field of Search ..... 222/148, 321.2, 222/321.3

[56] References Cited

U.S. PATENT DOCUMENTS

| | | | |
|---|---|---|---|
| 3,779,464 | 12/1973 | Malone | 222/321.3 X |
| 4,051,983 | 10/1977 | Anderson . | |
| 4,147,476 | 4/1979 | Warren | 222/321.2 X |
| 4,516,727 | 5/1985 | Saito et al. . | |
| 4,941,595 | 7/1990 | Montaner et al. . | |
| 5,105,988 | 4/1992 | Knickerbocker | 222/148 |
| 5,207,785 | 5/1993 | Knicknerbocker . | |
| 5,348,189 | 9/1994 | Cater . | |
| 5,358,149 | 10/1994 | O'Neill . | |
| 5,458,289 | 10/1995 | Cater . | |

*Primary Examiner*—Gregory L. Huson
*Attorney, Agent, or Firm*—Watson Cole Stevens Davis, P.L.L.C.

[57] ABSTRACT

A precompression pump sprayer has a variable volume suck-back chamber in communication with the discharge orifice for inwardly suctioning any residual liquid away from the orifice and the spin mechanics to avoid clogging as a result of dried accumulated product. In one embodiment a cover on the plunger head is spring loaded and therewith defines the suck-back chamber. In another embodiment the plunger head is spring loaded on the piston stem, such that in both embodiments a top end wall of the suck-back chamber is shiftable relative to the piston stem independently of piston reciprocation. The biasing spring has a spring force permitting a shifting of the end wall to reduce the volume of the suck-back chamber at a peak pressure reached in the pump chamber beyond the threshold pressure required to open the discharge valve, at which time the spring is compressed. The restoring force of the spring causes the top end wall to shift to expand the volume of the suck-back chamber.

14 Claims, 3 Drawing Sheets

51
54
19
55

52
22
23
48

48
37
52
14
23
24

51
55
54
19

48
49
37
53
51
19
52
28
32
30
29
31
21
13
23
26
14
12
24

PRECOMPRESSION PUMP SPRAYER HAVING SUCK-BACK FEATURE

BACKGROUND OF THE INVENTION

This invention relates generally to a precompression pump sprayer of the fingertip actuated variety, and more particularly to such a sprayer in which the plunger head or a cover on the head is spring loaded for shifting independently of the pump piston to define a variable volume suck-back chamber in communication with the discharge orifice and with the spin mechanics for inwardly suctioning any residual product away therefrom during the piston return stroke to avoid clogging, and for avoiding drooling of product from the orifice during pumping.

U.S. Pat. No. 5,458,289 discloses a precompression pump sprayer having a second pumping means defining a second chamber of variable volume which is decreased during the pumping pressure stroke and increased during the pumping return stroke. The second chamber is connected by a first valve to a dispensing channel during the return stroke for suctioning any residual liquid into the second chamber. And, the second chamber is connected by a second valve to an outlet port during the next pump pressure stroke.

U.S. Pat. No. 5,348,189 discloses an air purge pump dispenser which provides for quantities of liquid and air to be pressurized in separate chambers during pumping. Air is released during a terminal part of the actuating stroke through a dispensing channel leading to the discharge orifice, or air and liquid are mixed during the pumping pressure stroke so as to be dispensed together, and during a return stroke air is sucked through the dispensing channel to remove residual liquid.

U.S. Pat. No. 4,516,727 discloses a manually operated sprayer capable of discharging air to the nozzle orifice from within the sprayer during the spraying operation. On the piston return stroke, the air chamber expands for sucking air into that cylinder through the discharge orifice.

U.S. Pat. No. 5,358,149 discloses anti-clogging means for a precompression pump sprayer in which a variable volume inner air cylinder exhausts air through the discharge orifice during the pumping pressure stroke, and suctions air from that orifice during the piston return stroke to avoid clogging.

The known anti-clogging sprayers, however, generally provide for pressurization of an air chamber at the initiation of the pumping pressure stroke so that residual liquid at the discharge orifice and in the spin mechanics section leading thereto drools from the orifice before the product discharge valve opens, which is unacceptable. The variable volume air chamber is either in constant communication with the discharge orifice and the spin mechanics or is valved into communication therewith.

Besides, the prior art anti-clogging structures are somewhat complicated requiring additional parts adding to the cost of production and assembly of the pump.

The term "spin mechanics" used herein is intended to include the spin or swirl chamber, tangential channels feeding product into such chamber, and discharge channels or a channel leading from the discharge passage to the tangentials.

SUMMARY OF THE INVENTION

It is an object of the present invention to provide a suck-back or vac-back feature for a precompression pump sprayer in which a variable volume suck-back chamber, in open communication with the discharge orifice and with its spin mechanics, is reduced in volume during pumping upon reaching a peak pressure in the pump chamber which exceeds a threshold pressure at which a discharge poppet valve opens. The formation of dribbles and drips out of the discharge orifice is thus avoided during pumping before the discharge opens. The volume of the suck-back chamber immediately enlarges upon release of the external finger pressure applied to the plunger head or head cover at which time the discharge valve closes and any residual liquid from the discharge orifice and its spin mechanics is drawn inwardly by the negative pressure created in the expanded chamber for preventing clogging as a result of accumulated dried product. This residual liquid product is available for discharge together with the next charge of the pump upon discharge valve opening without drooling.

According to the invention the plunger head has a finger engageable, spring loaded end wall defining an upper end of the suck-back chamber and being shiftable relative to the piston to reduce the volume of such chamber at the end of the piston pressure stroke in response to peak pressure reached in the pump chamber above the threshold pressure at which the discharge valve opens. Upon the return stroke after the closing of the discharge valve, the end wall shifts back to its initial position relative to the piston under the action of the end wall spring for enlarging the suck-back chamber such that the sub-atmospheric pressure created therein draws any residual liquid inwardly away from the discharge orifice and its spin mechanics.

In one embodiment of the invention the separately shiftable plunger end wall comprises an orifice cover having a skirt portion covering the orifice in a condition of non-use and uncovering the orifice upon application of a slight external finger force against the bias of a first stage, weak spring. Upon a buildup of pressure in the pump chamber during the piston power stroke, a threshold pressure is reached which overcomes the force of the piston return spring to open the discharge. The pump pressure continues to increase to a peak pressure beyond the threshold pressure, the peak pressure overcoming the force of a second stage, stronger spring biasing the orifice cover so as to permit the orifice cover to travel the full displacement stroke with the piston. At the commencement of the piston upstroke, upon relaxation of downward pressure applied by the operator against the orifice cover, the restoring force of the second stage spring quickly returns the cover to its at rest position which enlarges the suck-back chamber for drawing residual liquid inwardly from the discharge orifice and its spin mechanics before the orifice is closed by the cover under the resilient action of the first stage spring.

According to another embodiment of the invention, the plunger head is mounted on the piston stem for independent shifting movement against the bias of a spring permitting relative shift after a peak pressure is reached in the pump chamber beyond the threshold pressure at which time the discharge valve opens at the end of the piston pressure stroke. Release of external pressure applied to the head by the operator allows the plunger head to shift under the action of its spring to enlarge the suck-back chamber for drawing in residual liquid product from the discharge orifice and its spin mechanics to avoid clogging as a result of dried accumulated product.

Other objects, advantages, and novel features of the present invention will become more apparent from the following detailed description of the invention when taken in conjunction with the accompanying drawings.

DETAIL OF THE DESCRIPTION OF THE INVENTION

Figure 1:
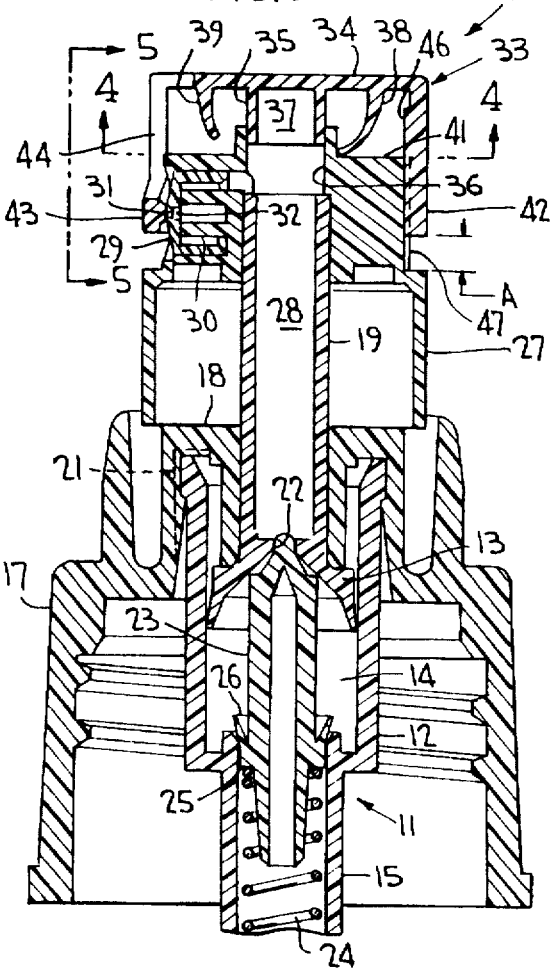
FIG. 1 is a vertical sectional view of a precompression pump sprayer having a suck-back feature according to one embodiment to the invention, shown in the condition of non-use.
Figure 2:
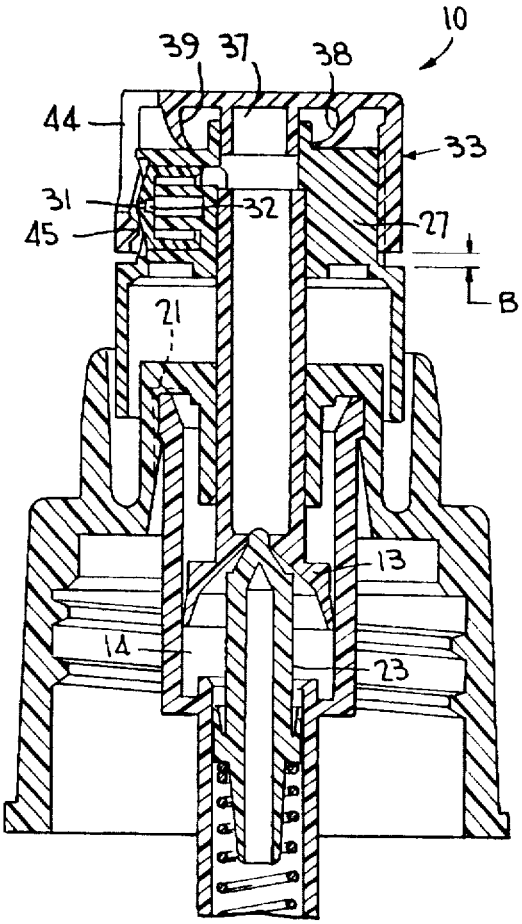
FIG. 2 is a view similar to FIG. 1 showing the pump piston lowered in its cylinder during the power stroke.
Figure 3:
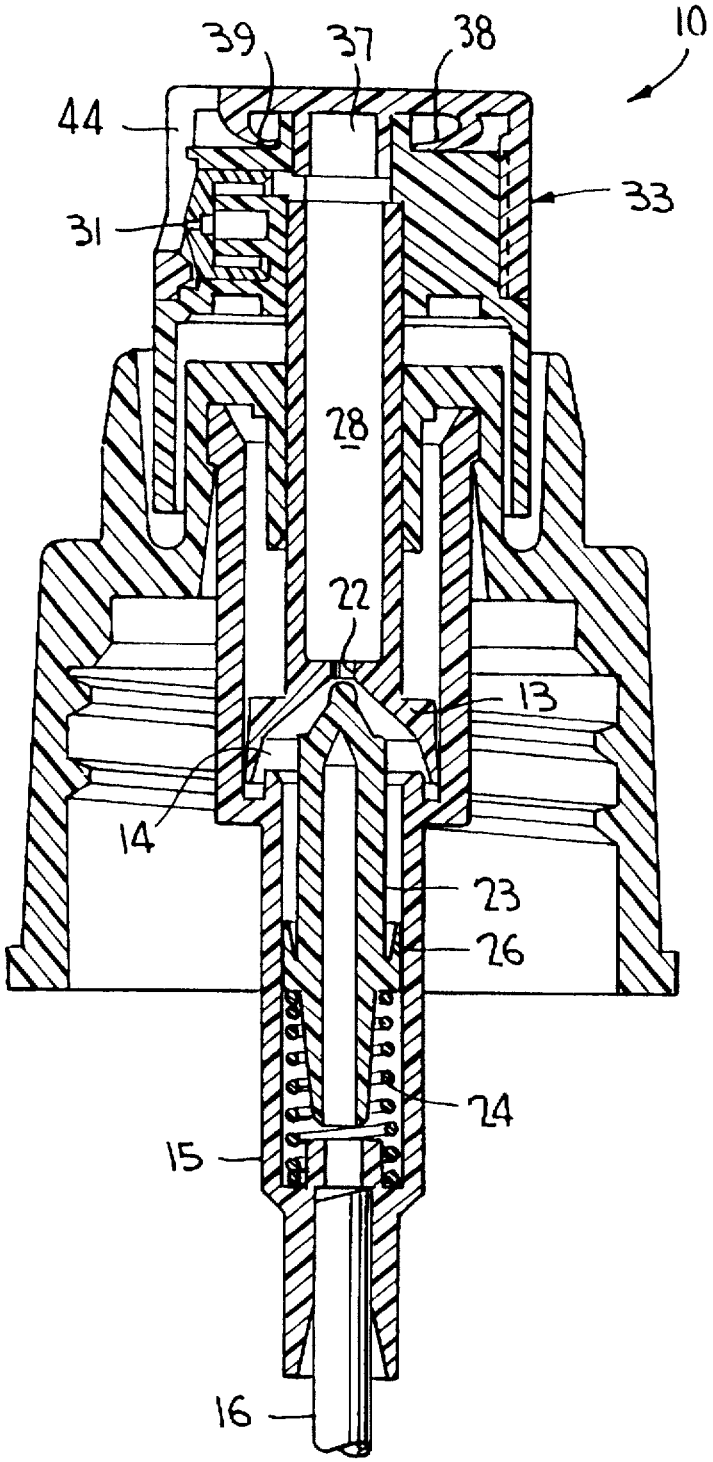
FIG. 3 is a view similar to FIG. 1 showing the pump piston at the end of its pressure stroke with the discharge valve open and the suck-back chamber fully reduced in volume.

Turning now to the drawings wherein like reference characters refer to like and corresponding parts throughout the several views, a precompression pump sprayer is generally designated 10 in FIGS. 1, 2 and 3 as comprising a pump body 11 having a pump cylinder 12 containing a reciprocable pump piston 13 which together with the cylinder defines a variable volume pump chamber 14. Pump cylinder 12 has a reduced diameter portion 15 supporting a dip tube 16 at its lower end extending into a container (not shown) to which the pump sprayer is mounted.

The upper end of the pump cylinder is snap-fitted or otherwise mounted within a threaded container closure 17 provided for mounting sprayer 10 to the threaded neck of the container. Crown portion 18 has a central opening through which a hollow piston stem 19 of the piston extends. A container vent groove 21 is provided in crown portion 18 for venting the container in a manner similar to that described in U.S. Pat. No. 4,051,983. Of course, the closure can otherwise be of the known ferrule type for engagement with an annular bead on the container neck, without departing from the invention.

The piston stem has a discharge valve seat 22 against which the nose of a discharge poppet valve 23 is seated in the non-use or at rest position of the pump sprayer of FIG. 1. The poppet valve is spring biased into its closed position by the provision of a piston return spring 24 which may be in the form of a coil spring extending between a shoulder 25 of the poppet valve and the lower end of reduced diameter portion 15.

The poppet has an inlet valve seal 26 which may in the form of a resilient, upwardly directed conical valve chevron which disengages from the wall of the upper end of portion 15 for inletting liquid product into the pump chamber during each suction stroke of the piston, and which resiliently deforms as in FIG. 2 for closing the inlet passage during pumping.

Plunger means comprising a plunger head 27 is fixably mounted at the upper end of piston stem 19, the hollow piston stem defining a discharge passage 28 opening into the head. Mounted in the plunger head is an orifice cup 29 having an end wall containing a discharge orifice 31, the orifice cup surrounding a probe 30 and therewith defining some type of spin mechanics 32 as known in the art for creating a vortex of liquid product fed from the discharge passage such that liquid is discharged through orifice 31 in the form of a fine mist spray during pumping.

The plunger means further comprises a cover means 33 comprising a top end wall 34 having a depending sleeve 35 in sliding sealing engagement with the wall of a conduit 36 formed in the plunger head coaxial with the discharge passage. Sleeve 35 and conduit 36 together define a variable volume suck-back chamber 37.

Figure 4:
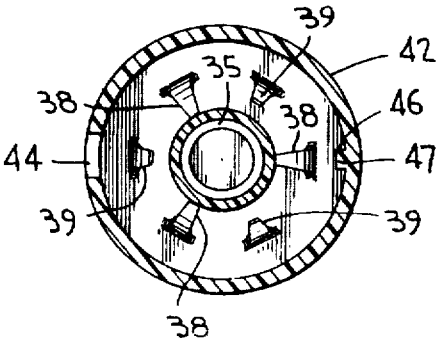
FIG. 4 is a sectional view taken substantially along the line 4—4 of FIG. 1.
Figure 5:
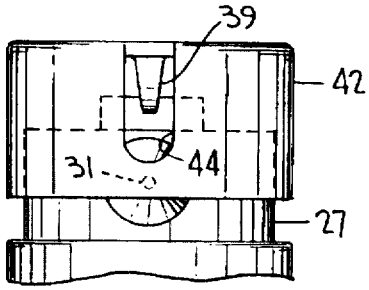
FIG. 5 is an end view taken substantially along the line 5—5 of FIG. 1.

The cover means is axially shiftable relative to the plunger head and the pump piston against the bias of spring means comprising a first stage spring which may be in the form of a plurality of evenly spaced, relatively weak spring legs or leaf springs 38. The spring means further comprises a second stage spring which may be in the form of a plurality of evenly spaced spring legs or leaf springs 39 having a spring force stronger than that of the first stage spring and interdigitated therewith for balance of the cover means, as shown in FIG. 4. In the example shown, the depending spring legs are integrally molded with wall 34, and legs 38 bear against upper surface 41 of the plunger head in the at rest position shown in FIG. 1. The spring means having first and second stage springs may otherwise be in the form of a coil spring in which the spring turns of one section thereof have a spring force greater than the spring turns of an adjoining section, without departing from the invention. And, still other types of spring means having first and second stage springs or spring sections for carrying out the invention can be provided.

Cover means 33 further comprises a skirt 42 depending from end wall 34 and surrounding the plunger head in telescoping relation. Skirt 42 has a portion 43 covering the discharge orifice in the at rest position of FIG. 1, and has an opening 44 adjacent portion 43 for uncovering the discharge orifice in a manner to be explained more fully hereinafter. And, an internal projection 45 on portion 43 may be provided for seating against the discharge orifice in the FIG. 1 position, as disclosed in U.S. Pat. No. 5,207,785, commonly owned herewith.

A vertical rib 46 may be provided on the plunger head for reception within a vertical groove 47 in skirt 42 (see also FIG. 4) for orienting cover means 33 to assure alignment between opening 44 and the discharge orifice. And, a catch (not shown) of some type may be provided as acting between cover means 33 and the plunger head for preventing the separation of the cover means from its head in the FIG. 1 position.

In operation, with the pump chamber fully primed with product, upon application by the operator of a downward finger force against end wall 34, cover means 33 is shifted downwardly from its position of FIG. 1 to that of FIG. 2 against the bias of first stage spring legs 38 to first uncover the orifice as shown. The cover means shifts from a distance A (FIG. 1) set at approximately 0.08 inches to a relative distance B (FIG. 2), a distance of about 0.03 inches relative to the plunger head. The first stage travel from distance A to distance B is effective upon the application of an external actuation force. The orifice is uncovered during this first stage of travel and the volume of suck-back chamber 37 is reduced, although the volume reduction is insufficient to increase the pressure much, if at all, above atmospheric in this chamber sufficient to purge any residual liquid product from discharge orifice 31 or from its spin mechanics. It is expected that upon this initial volume reduction of the suck-back chamber some residual product within conduit 36 is merely directed toward the vicinity of the spin mechanics but does not enter the spin mechanics.

The spring force of legs 38 is designed to facilitate a relative shifting of the cover means between its FIG. 1 and FIG. 2 positions, and is designed to transmit the applied external force to plunger head 27 causing the piston to reciprocate in its cylinder (FIG. 2). During this course of travel, as in any precompression pump sprayer, the discharge poppet valve 23 is lowered together with the piston, and with the inlet and discharge valves closed, pressure within pump chamber 14 builds up to a threshold pressure near the beginning of the piston downstroke which overcomes the force of piston return spring 24. At this threshold pressure poppet valve 23 is forced to reciprocate downwardly within its cylinder portion 15 away from piston 13 and its valve seat 22 to open the discharge as shown in FIG. 3.

For a typical precompression pump sprayer, it has been shown that the accumulated pressure in the pump chamber continues to build beyond the threshold pressure to a peak pressure during pumping. At or just prior to reaching the threshold pressure, the spring legs of the second stage spring engage surface 41 of the plunger head. The force of the second stage springs are so designed that the pump pressure which builds to peak exceeds the force of second stage springs 39 causing cover means 33 to shift relative to the plunger head the remaining 0.03 inch, as shown in FIG. 3, whereupon the volume of suck-back chamber 37 is reduced.

Restating the operation of the pump, cover means 33 travels relative to the plunger head only to first stage B while the piston is downwardly reciprocated prior to discharge valve opening at which point second stage springs 39 engage the top of the plunger head. The dynamic peak pressure reached in the pump chamber exceeds the force of the second stage springs, as designed for this purpose, so that cover means 33 travels the full displacement stroke.

Upon release of the externally applied actuation force, cover means 33 returns to its at rest position of FIG. 1 during the piston return stroke due to the restoring force of the first and second stage springs. The volume of chamber 37 thus expands creating a slight sub-atmospheric pressure therein to suction residual product inwardly away from the discharge orifice and its spin mechanics. The volume of the suck-back chamber expands in two stages; a first stage back to that shown in FIG. 2, and a second stage back to that shown in FIG. 1 at which the suck-back chamber volume is fully expanded. Clogging of the orifice is thus avoided, while at the same time the residual liquid sucked back is made available for dispensing during the next power stroke but without dribbling or drooling from the orifice before the pump starts to spray.

According to another embodiment of the invention, the pump sprayer of FIGS. 6 to 9, generally designated 48, is similar to pump sprayer 10 in structure and operation except that it eliminates the first stage springs and the orifice cover.

Instead, a spring loaded plunger head 49 is mounted on piston stem 19 for shifting movement relative thereto.

The head has an inner depending sleeve 51 to which probe 30 is molded, the sleeve being telescoped about the upper end of the piston stem as shown. Spring means, which may be in the form of a chevron spring 52 molded to sleeve 51, bears against the upper end of the piston stem. A suck-back chamber 37 is defined beneath top end wall 53 of the plunger head.

Figures 6, 7, 8, 9, 10:
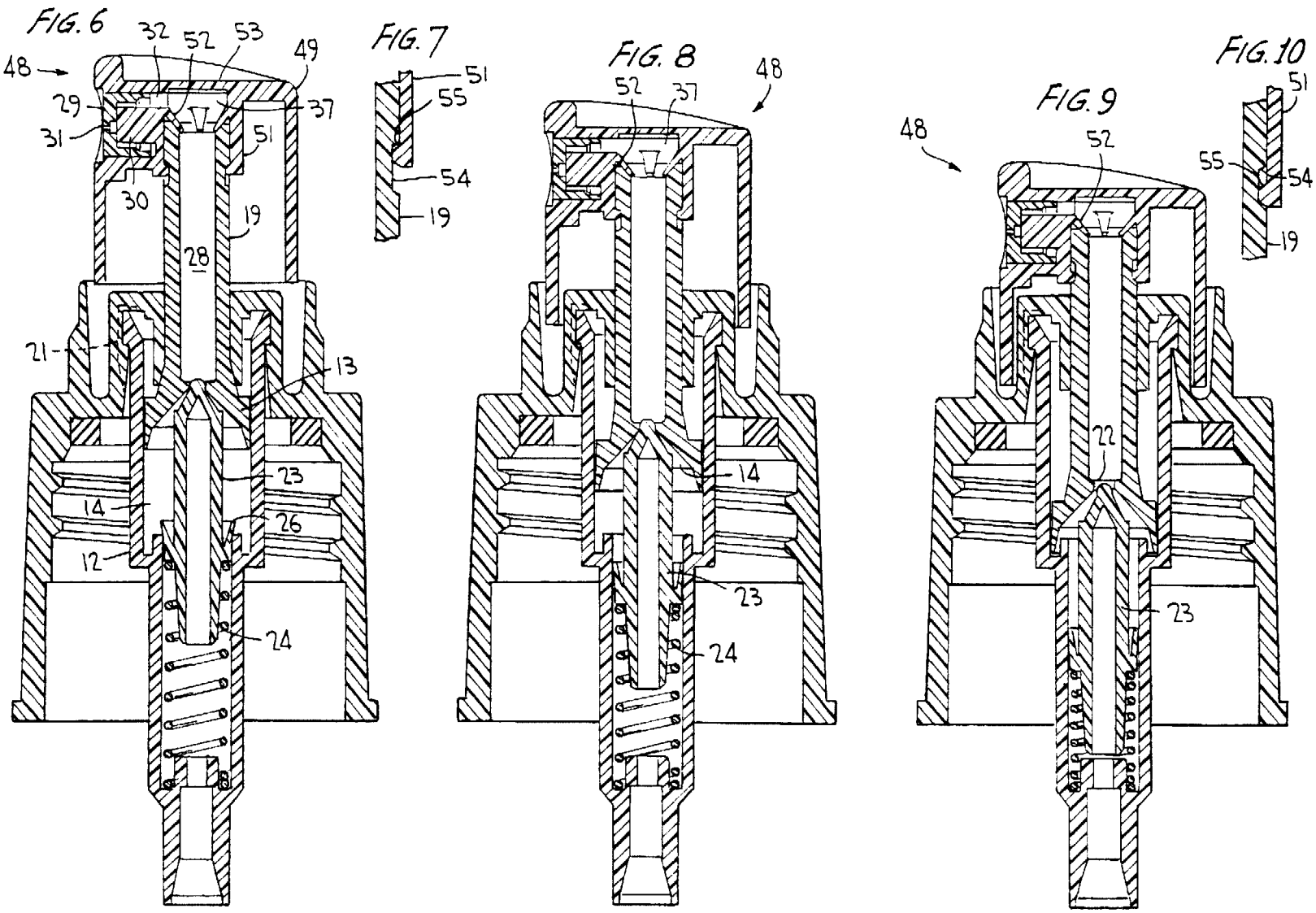
FIG. 6 is a vertical sectional view of a precompression pump sprayer incorporating a suck-back feature according to another embodiment of the invention.
FIG. 7 is an enlarged detail view in section showing the relationship between the plunger head and the piston stem in the non-use condition of FIG. 6.
FIG. 8 is a view similar to FIG. 6 showing the piston at the end of its pressure stroke prior to opening of the discharge valve.
FIG. 9 is a view similar to FIG. 8 showing the discharge valve open.
FIG. 10 is a view similar to FIG. 7 showing the relationship between the plunger head and the piston stem in the FIG. 9 condition.

The piston stem has an outer, annular, wide groove 54, shown in detail in FIG. 7, and the lower end of sleeve 51 has an internal annular bead 55 of a width less than that of groove 54.

In operation, after the pump chamber is primed with liquid product to be sprayed, application of an external finger force to end wall 53 of the plunger head is transmitted directly to pump piston 13 via spring 52 without compressing the spring. The spring has a sufficiently strong force permitting an actuation force to be downwardly applied against the plunger head without causing any relative shifting of the plunger head to the stem, at the initiation of the downstroke of the piston during piston actuation.

As in the first embodiment, discharge poppet valve 23 is lowered by the pump piston during the pressure stroke while the piston builds up pressure in the valve closed pump chamber. During the pressure stroke, the pressure in pump chamber 14 builds to a threshold pressure sufficient to overcome the opposing force of the piston return spring 24. At that threshold pressure the poppet valve is shifted away from its valve seat 22 to open the discharge. As the pressure in the pump chamber continues to build during the pressure stroke to a peak pressure beyond its threshold level, which peak pressure exceeds the design force of spring 52, there is a relative shift between the piston and the plunger head a distance permitted by the width of groove 54 (see FIG. 10), whereupon the volume of suck-back chamber 37 is reduced, and the piston is permitted to bottom out in its cylinder while the discharge remains open.

As in the first embodiment, this volume reduction in chamber 32 does not create a pressure sufficient to purge residual product from the discharge orifice and its spin mechanics, but rather directs movement of a small amount of product toward the spin mechanics. The poppet shifts to reclose the discharge when the pressure in the pump chamber is overcome by the return force of spring 24. And, upon relaxation of the externally applied pressure to the plunger head, spring 52 relatively shifts plunger head from its FIG. 10 back to its FIG. 7 position which causes chamber 37 to expand to thereby inwardly draw residual liquid product from the discharge orifice and its spin mechanics to thereby avoid clogging and any restriction in the flow path leading to the orifice which would interfere with the performance of the pump sprayer.

At the end of the suction stroke shown in FIG. 6, valve seal 26 of the poppet disengages from the wall of cylinder 12 for the inletting of liquid product into the pump chamber from the dip tube due to the negative pressure created in the pump chamber upon chamber expansion.

Spring 52 is chosen as having a spring rate which exceeds pump chamber pressure as it builds to its threshold level, but which is overcome by the dynamic peak pressure reached in the pump chamber beyond the threshold level.

A chevron spring has been illustrated, although the invention is not so limited. A coil spring, leaf springs, or the like, could be substituted without departing from the scope of the invention.

From the foregoing, it can be seen that a simple and economical yet highly effective fluid suck-back mechanism has been developed for a precompression pump sprayer of the finger actuated type as comprising a suck-back chamber which expands in volume at or after the closing of the discharge valve for inwardly suctioning any residual liquid away from the discharge orifice and its spin mechanics, to avoid clogging which would interfere with the performance of the pump. Enlargement and reduction of the suck-back chamber is facilitated by a spring loaded cover means on the plunger or by a spring loaded plunger head. Volume reduction of the suck-back chamber is insufficient to create sufficient pressure which purges residual liquid product through the discharge orifice as in the prior art. Any slight pressure created during volume reduction is expected to direct any residual liquid only in the direction toward but not through the orifice.

The force of the second stage spring of the FIG. 1 embodiment, and the force of the single stage spring of FIG. 6, are respectively overcome upon reaching the dynamic peak pressure in the pump chamber for reducing the volume of the suck-back chamber. Upon relaxation of the external force applied against the plunger means, chamber 37 expands under the action of the restoring force of plunger spring means for carrying out the anti-clogging operation.

Although a single-piece poppet valve has been illustrated, a multi-part poppet of the type disclosed in the U.S. Pat. No. 4,051,983 patent is suitable as a discharge valve for the sprayer of the invention. Also, the precompression pump sprayer of U.S. Pat. No. 4,941,595 having a separate poppet return spring is adaptable for incorporating the suck-back feature of the invention. The invention may likewise be incorporated into other pressure buildup sprayers in accordance with the aforedescribed.

Obviously, many other modifications and variations of the present invention are made possible in the light of the above teachings. It is therefore to be understood that within the scope of the appended claims the invention may be practice in otherwise than as specifically described.

What is claimed is:

1. A precompression liquid pump sprayer comprising, a pump body having a pump piston reciprocable in a pump cylinder to therewith define a variable volume pump chamber, said piston having a discharge valve seat and a hollow stem defining a valve controlled fluid discharge passage therethrough, a discharge poppet valve engaging said valve seat in a discharge closed position under the bias of a return spring, plunger means on an end of said stem for reciprocating said piston to open said discharge valve upon reaching a threshold pressure within said pump chamber, said plunger means including a discharge spray nozzle having a discharge orifice and spin mechanics in communication with said discharge passage, the improvement wherein:

said plunger means has a manually engageable, spring loaded top end wall axially, independently shiftable relative to said piston to define a variable volume suck-back chamber in said plunger means in open communication with said discharge passage;

spring means for spring loading said plunger means, comprising a spring having a predetermined spring force less than an opposing peak pressure reached in said pump chamber which peak pressure exceeds said threshold pressure during pumping;

said end wall shifting toward said piston stem upon a spring loading of said spring in response to said peak pressure, to thereby reduce the volume of said suck-back chamber, and said end wall shifting away from said piston stem in response to a restoring force of said spring during a return stroke of said piston, to thereby expand said suck-back chamber for inwardly drawing any residual product away from said discharge orifice and said spin mechanics.

2. The pump sprayer according to claim 1, wherein said plunger means comprises a plunger head containing said nozzle and said spin mechanics and being fixedly mounted on said end of said stem, and cover means including said top end wall, said spring means further comprising a first a stage spring of a given spring force sufficient to transmit an applied external finger force from said top end wall to said plunger head for reciprocating said piston, said spring comprising a second stage spring and said predetermined spring force thereof exceeding said given force.

3. The pump chamber according to claim 2, wherein said first stage spring at said given spring force responds to said applied external finger force permitting said cover means to shift toward said plunger head during a first stage movement before commencement of piston reciprocation, and to shift away from said plunger head during said return stroke.

4. The pump sprayer according to claim 3, wherein said first and second stage spring comprise leaf springs integral with said cover means.

5. The pump sprayer according to claim 3, wherein said cover means has a depending skirt surrounding said head, a portion of said skirt covering said orifice in an at rest condition of the sprayer, said skirt having an opening adjacent said skirt portion for alignment with said orifice for uncovering said orifice during said first stage movement.

6. The pump sprayer according to claim 5, wherein said skirt has an integral projection extending into said orifice in said at rest condition for wiping the orifice clean of any accumulated dried liquid upon the shifting of said cover means toward and away from said plunger head.

7. The pump chamber according to claim 6, wherein said plunger means solely comprises a plunger head fixedly mounted on said end of said stem, said plunger head including said top end wall.

8. The pump chamber according to claim 7, wherein said plunger had has a depending skirt engaging said end of said piston stem for axial shifting movement relative thereto.

9. The pump chamber according to claim 8, wherein one of said end of said stem and said skirt has a groove and the other thereof has a cooperating projection, said groove being wider in an axial direction compared to said projection for limiting the relative shifting of said plunger means.

10. A precompression liquid pump sprayer comprising, a pump body having a pump piston axially reciprocable in a pump cylinder to therewith define a variable volume pump chamber, said piston having a discharge valve seat and a hollow stem defining a valve controlled fluid discharge passage therethrough, a discharge poppet valve engaging said valve seat in a discharge closed position under the bias of a return spring, a plunger head on an end of said stem for reciprocating said piston between pressure and return strokes, said plunger head having a spray nozzle mounted therein including a discharge orifice and spin mechanics in communication with said discharge passage, the improvement wherein:

cover means is mounted on said head for axial shifting movement relative thereto against the bias of spring means;

said cover means defining with said head a variable volume suck-back chamber in open communication with said discharge passage;

said spring means acting between said cover means and said head;

said cover means comprising a top end wall having a depending skirt surrounding said head, a portion of said skirt covering said orifice in a condition of non-use, said skirt having an aperture adjacent said skirt portion for alignment with said orifice for uncovering said orifice in a condition of use;

said spring means comprising a first stage spring having a given spring force permitting said cover means to shift from an initial to a first position toward said head to uncover said orifice and to reduce the volume of said suck-back chamber prior to initiation of a pressure stroke of said piston and to transmit an externally applied finger force to said head during said pressure stroke;

said spring means comprising a second stage spring having a predetermined spring force stiffer than said given spring force for permitting said cover means to fully shift from said first position to a second position toward said head to further reduce the volume of said suck-back chamber upon reaching a peak pressure in said pump chamber which exceeds a threshold pressure sufficient to open said discharge valve; and said spring means returning said cover means to said initial position during a return stroke of said piston for expanding said suck-back chamber creating a sub-atmospheric pressure to suction any residual liquid inwardly away from said discharge orifice and said spin mechanics.

11. The pump sprayer according to claim 10, wherein said spring means comprise leaf springs integral with said top end wall.

12. A precompression liquid pump sprayer comprising, a pump body having a pump piston axially reciprocable in a pump cylinder to therewith define a variable volume pump chamber, said piston having a discharge valve seat and a hollow stem defining a valve controlled fluid discharge passage therethrough, a discharge valve engaging said valve seat in a discharge closed position under the bias of a return spring, a plunger head on an end of said stem for reciprocating said piston between pressure and return strokes, said head having mounted therein a spray nozzle having a discharge orifice and spin mechanics in communication with said discharge passage, the improvement wherein:

said plunger head has a depending sleeve engaging said end of said stem and a top end wall defining with said stem a variable volume suck-back chamber in open communication with said discharge passage;

said head engaging said stem for axial shifting movement relative thereto against the bias of spring means;

said spring means having a predetermined spring force for transmitting an externally applied finger force to said head while resisting a relative shifting of said head during said pressure stroke but permitting a relative shifting together of said head and said stem to reduce the volume of said suck-back chamber in response to a peak pressure reached in said pump chamber which exceeds a threshold pressure sufficient to open said discharge valve; and a restoring force of said spring means causing a relative shifting apart of said head and said stem during said return stroke for expanding the volume of said suck-back chamber creating a sub-atmospheric pressure to inwardly suction any residual liquid away from said discharge orifice and said spin mechanics.

13. The pump sprayer according to claim 12, wherein axially spaced limit stops are provided between said head and said stem for limiting the relative shifting of said head and said stem.

14. The pump sprayer according to claim 12, wherein said spring comprises a flexible chevron integral with said head.

* * * * *